US011095054B2

(12) United States Patent
Witte

(10) Patent No.: US 11,095,054 B2
(45) Date of Patent: Aug. 17, 2021

(54) CONDUCTOR TERMINAL AND METHOD OF ASSEMBLING A CONDUCTOR TERMINAL

(71) Applicant: WAGO Verwaltungsgesellschaft mbH, Minden (DE)

(72) Inventor: Thomas Witte, Porta Westfalica (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/027,473

(22) Filed: Sep. 21, 2020

(65) Prior Publication Data

US 2021/0091485 A1 Mar. 25, 2021

(30) Foreign Application Priority Data

Sep. 20, 2019 (DE) ..... 10 2019 125 410.8

(51) Int. Cl.
*H01R 4/48* (2006.01)
*H01R 13/629* (2006.01)

(52) U.S. Cl.
CPC ..... *H01R 4/4863* (2013.01); *H01R 13/62955* (2013.01)

(58) Field of Classification Search
CPC ... H01R 4/4836; H01R 4/4845; H01R 4/4827
See application file for complete search history.

(56) References Cited

U.S. PATENT DOCUMENTS

| | | | | |
|---|---|---|---|---|
| 8,129,641 | B2 * | 3/2012 | Majewski | H01R 4/4836 200/335 |
| 10,367,272 | B2 | 7/2019 | Witte et al. | |
| 2015/0093925 | A1 | 4/2015 | Bruchmann | |

FOREIGN PATENT DOCUMENTS

| | | | |
|---|---|---|---|
| DE | 10 2013 110 789 | B3 | 12/2014 |
| DE | 20 2015 103 176 | U1 | 8/2015 |
| DE | 10 2015 122 143 | A1 | 6/2017 |
| DE | 10 2016 115 601 | A1 | 3/2018 |
| DE | 10 2016 118 331 | A1 | 3/2018 |
| DE | 20 2017 100 871 | U1 | 6/2018 |
| DE | 10 2017 108 171 | A1 | 10/2018 |
| EP | 2 140 521 | B1 | 11/2012 |
| WO | WO 2019/192911 | A1 | 10/2019 |

* cited by examiner

*Primary Examiner* — Ross N Gushi
(74) *Attorney, Agent, or Firm* — Muncy, Geissler, Olds & Lowe, P.C.

(57) ABSTRACT

A conductor terminal with at least one spring force terminal connection for the connection of an electrical conductor via spring force clamping. The spring force terminal connection has a clamping spring. The conductor terminal has a housing and an actuating lever which is pivotably mounted in a pivoting plane in the housing for actuating the clamping spring. The actuating lever is formed with at least one clamping spring actuator element and at least one control element. The clamping spring actuator element actuates the clamping spring and the control element has at least one handle portion for manually actuating the actuating lever. The control element and the clamping spring actuator element have mutually corresponding fastening elements, via which the control element and the clamping spring actuator element are form-fittingly and/or force-fittingly connected to one another.

14 Claims, 8 Drawing Sheets

CONDUCTOR TERMINAL AND METHOD OF ASSEMBLING A CONDUCTOR TERMINAL

This nonprovisional application claims priority under 35 U.S.C. § 119(a) to German Patent Application No. 10 2019 125 410.8, which was filed in Germany on Sep. 20, 2019, and which is herein incorporated by reference.

BACKGROUND OF THE INVENTION

Field of the Invention

The present invention relates to a conductor terminal according to the preamble of claim 1. The invention also relates to a method for assembling such a conductor terminal.

Description of the Background Art

Conductor terminals with an actuation of the clamping spring by an actuation lever are known, for example, from DE 10 2016 118 331 A1. The lever actuation allows for simple and comfortable actuation of the clamping spring. No separate tool is required.

However, in the conventional art, an integration of an actuating lever into a conductor terminal is associated with additional technical effort and space requirements.

SUMMARY OF THE INVENTION

It is therefore an object of the present invention to improve a conductor terminal with lever actuation. In addition, a method for assembling the individual parts of such a conductor terminal is to be specified.

This object is achieved in an exemplary embodiment by a conductor terminal in that the control element and the clamping spring actuator element have fastening elements that correspond to one another, via which the control element and the clamping spring actuator element are at least form-fittingly connected to one another and are fixed in position to one another at least in the pivoting plane of the actuating lever. This makes it possible for the entire actuating lever to perform the desired pivoting movement in the pivoting plane, that is to say that the clamping spring actuator element immediately follows the pivoting movement specified manually by the actuator element.

The control element and the clamping spring actuator element can, for example, be connected to one another at least in a form-fitting manner in such a way that they are locked to one another and/or are connected to one another via one or more press connections. The connection point between the control element and the clamping spring actuator element can be further secured by additional fixing measures, for example by an adhesive connection. The at least form-fitting connection between the control element and the clamping spring actuator element can be designed to be releasable or non-releasable.

An advantage is that such a multi-part design of the actuating lever simplifies the assembly of the actuating lever in the housing. The individual parts of the actuating lever can be used individually so that the space required for inserting such a relatively small component is less than if a complete actuating lever is to be installed. The design of the actuating lever with fastening elements corresponding to one another on the control element and on the clamping spring actuator element also enables simple assembly by simply putting together, for example snapping together, the components. As a result of this design of the actuating lever, such a lever-actuated conductor terminal can be made more economical and more compact overall. In addition, it is possible to make the necessary openings in the housing smaller, which is advantageous with regard to the required air path and creepage distances. The housing can be designed as an insulating housing, for example.

In the conductor terminal according to the invention, it is in particular possible to initially only insert the clamping spring actuator element into the housing and then to insert the control element separately into the housing and connect it to the clamping spring actuator element. The control element can be introduced via a different housing opening than the clamping spring actuator element.

The clamping spring actuator element can be arranged completely in the area surrounded by the housing. Naturally, parts of the actuating lever, such as the handle portion, are also accessible from the outside, that is to say they protrude from the housing at least in certain pivoting positions of the actuating lever.

The clamping spring can, for example, have a clamping leg, a spring arch adjoining the clamping leg and a contact leg adjoining the spring arch. The contact leg serves to support the clamping spring in the conductor terminal, i.e. to support the clamping spring against the clamping force of the clamping leg. The clamping leg can have a clamping edge at the free end, as a result of which reliable clamping of an electrical conductor is supported.

The actuating section of the clamping spring actuator element serves to deflect the clamping leg of the clamping spring when the actuating lever is pivoted. In this way, a clamping point which is formed with the clamping leg can be opened. The actuating lever can have an open position or a closed position. In the open position, the clamping point is open. In the closed position, the clamping point is closed. In this state, an electrical conductor can be clamped by the clamping leg at the clamping point.

The control element and the clamping spring actuator element can be fixed in position relative to one another in all spatial directions by the at least form-fitting connection by means of the mutually corresponding fastening elements. The control element and the clamping spring actuator element are rigidly coupled to one another in this way in all directions. In this way, an actuating lever is created which does not differ from conventional actuating lever designs in terms of its operation and functioning. There is no change for the user as compared to known lever-operated conductor terminals.

The clamping spring actuator element can have two spaced-apart bearing disks, which are pivotably mounted on parts of the conductor terminal, and the actuating section extends between the bearing disks. This allows for a reliable and space-saving mounting of the actuating lever in the conductor terminal. The mounting of the actuating lever can also be designed to be wear-resistant, so that a large number of actuations of the actuating lever is possible. The actuating section can in particular extend from one bearing disk to the other spaced-apart bearing disk and thus form a bridge between these bearing disks.

The bearing disks each can have a part-circular outer contour. This allows for an ergonomically favorable, uniform pivoting movement of the actuating lever. The bearing disks can be supported, for example, on parts of the housing and/or on parts of the busbar of the conductor terminal.

The bearing disks can also have an eccentric outer contour. Furthermore, it is conceivable that two different bearing disks are also used, so that a type of step function can be implemented for the movement of the actuating lever, in particular of the actuating section. In any case, the sequence of movements of the actuating section can be structurally influenced with such designs of the clamping spring actuator element.

The bearing disks can each have fastening elements that correspond to fastening elements of the actuator element, so that the control element can be connected to the bearing disks at least in a form-fitting manner. The control element can, for example, have two fastening arms which are spaced apart from one another and which are connected to one another via the handle portion. In each case one fastening arm can be connected at least in a form-fitting manner to a fastening element of a bearing disk. Accordingly, the control element can have an essentially U-shaped design, namely with fastening arms protruding laterally from the handle portion. The mounting arms can, for example, extend angled in a side view, e.g. at right angles to the handle portion.

A passage space can be present between the bearing disks for passing through to a clamping point of the spring force terminal connection. This has the advantage that the installation space required by the actuating lever can also be used at least partially for the implementation and arrangement of an electrical conductor that is to be clamped in the conductor terminal. The clamping point can be arranged behind the passage space or within the passage space in the conductor insertion direction of the electrical conductor.

The conductor terminal can have at least one busbar and that the clamping point is formed between the free end of the clamping leg of the clamping spring and the busbar.

The clamping spring actuator element can be at least partially supported on a contact leg of the clamping spring. For example, the bearing disks mentioned can be supported on the contact leg.

The conductor terminal can be composed of a first and a second assembly module. This can be implemented, for example, in such a way that the first assembly module is provided as a structural unit and the second assembly module is provided as a further structural unit and these finished structural units are combined. The first assembly module can comprise a first housing part of the housing of the conductor terminal, the clamping spring and the clamping spring actuator element, or consist of these parts. The clamping spring and the clamping spring actuator element can be inserted entirely or partially into the first housing part. The second assembly module can have a second housing part of the housing of the conductor terminal, a busbar and the actuator element, or consist of these parts. The busbar and the control element can be inserted completely or partially into the second housing part.

The above-mentioned object is also achieved by a method for assembling a conductor terminal, which is composed of a first and a second assembly module, wherein the first assembly module comprises a first housing part of the housing of the conductor terminal, the clamping spring and the clamping spring actuator element, and the second assembly module comprises a second housing part of the housing of the conductor terminal, a busbar and the actuator element, with the following steps: providing a first assembly module, providing a second assembly module, joining the first and second assembly modules, wherein the control element and the clamping spring actuator element are connected to one another at least in a form-fitting manner and are fixed in position to one another at least in the pivoting plane of the actuating lever.

The advantages explained above can also be realized in this way. The conductor terminal can be easily installed either manually, or fully or partially automatically. The first assembly module can be inserted into the second assembly module, for example.

According to an advantageous embodiment of the invention, it is provided that the first assembly module can be formed with the following steps: providing the first housing part, inserting the clamping spring into the first housing part, deflecting the clamping leg of the clamping spring away from the contact leg of the clamping spring and inserting the clamping spring actuator element through a free space formed between the clamping leg and the contact leg into an area between the clamping leg and the contact leg, and if necessary, aligning the clamping spring actuator element into an assembly position in which the clamping spring actuator element can be connected to the control element at least in a form-fitting manner.

Here, the clamping spring actuator element can be pressed through the clamping leg into the angle between the contact leg and the connecting leg and held in an assembly position.

According to an advantageous embodiment of the invention, it is provided that the second assembly module can be formed with the following steps: providing the second housing part, inserting the busbar into the second housing part, inserting the control element of the actuating lever into the actuation opening of the second housing part, and If necessary, aligning the control element into an assembly position in which the clamping spring actuator element can be connected to the control element at least in a form-fitting manner.

The alignment of the control element into an assembly position can for example take place by pivoting the control element into an open position, in which in the finished conductor terminal, the clamping leg is deflected by the clamping spring actuator element into an open position with respect to the contact leg.

The control element can be inserted into the housing part and/or is latched with the clamping spring actuator element in an open position of the actuating lever, in which the clamping leg is deflected into an open position by the clamping spring actuator element. In this way, the control element can still be inserted and latched to the clamping spring actuator element even when the conductor terminal is already assembled, in particular when the housing parts are assembled.

The control element can be introduced into the housing part through a different opening in the housing part than the clamping spring actuator element. The control element can be introduced into the housing part, for example, through an actuation opening of the housing part which is specifically provided for the implementation of the actuating lever. The clamping spring actuator element can, for example, be introduced through an opening which is arranged on a different housing side of the housing part than the actuation opening, e.g. through an opening provided for inserting the busbar.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1B:
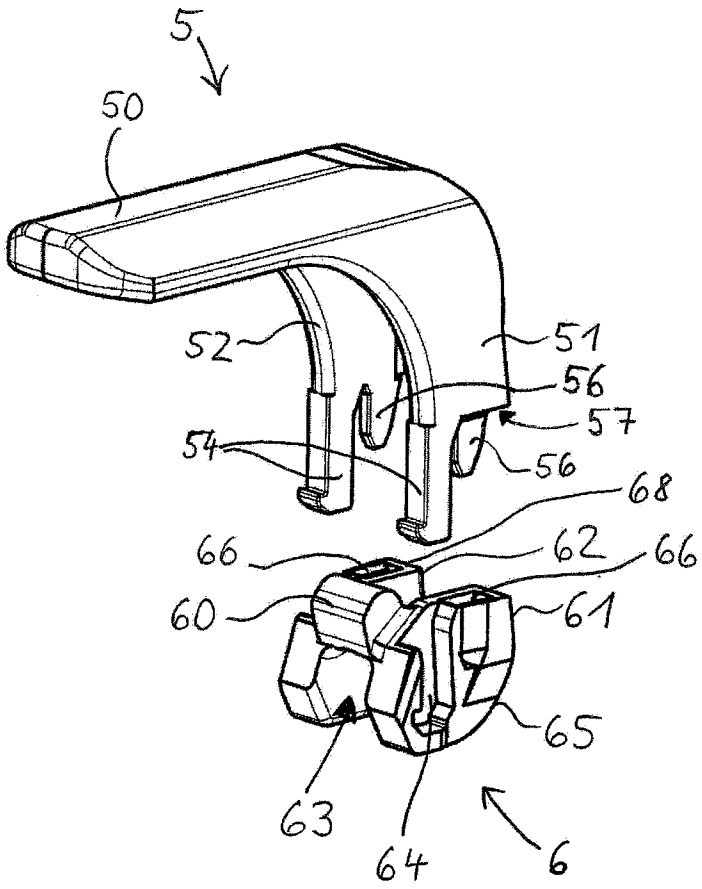
FIGS. 1A and 1B show an actuating lever in different perspective views.
Figure 1A:
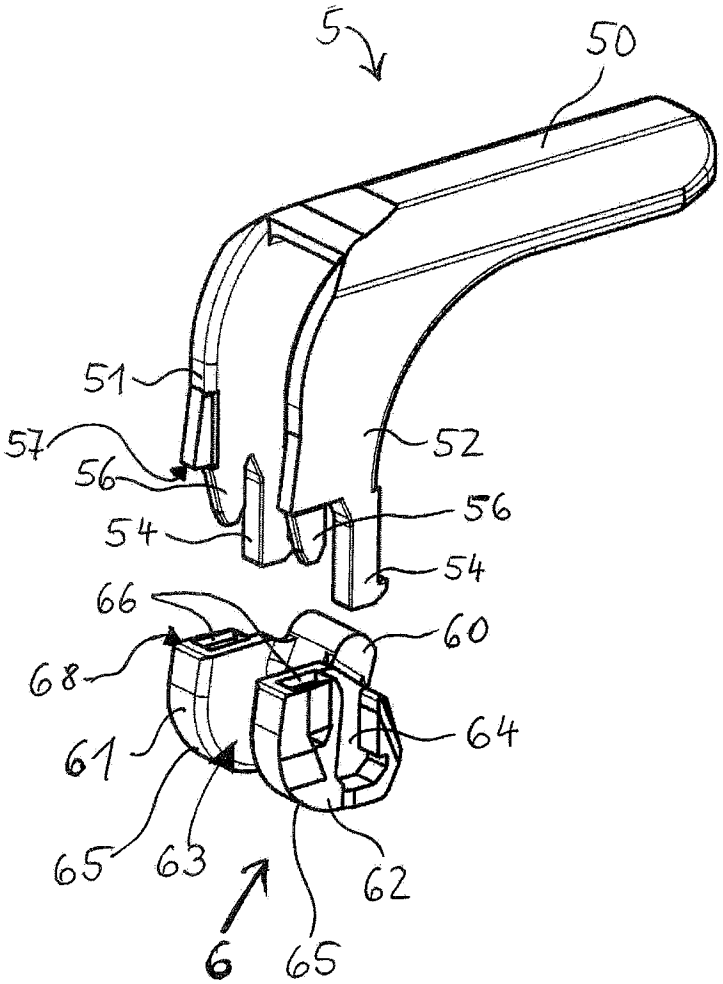

The actuating lever 5, 6 shown in FIG. 1 has a control element 5 and a clamping spring actuator element 6. The control element 5 and the clamping spring actuator element 6 are designed as separate components which can be joined to form the actuating lever 5, 6 by being locked together. For example, these components can be designed as individual plastic injection-molded components.

The control element 5 has a handle portion 50 on which the control element 5 or the entire actuating lever can be operated manually by a user. Two fastening arms 51, 52 extending at a distance from one another protrude laterally from the handle portion 50 and extend at an angle to the handle portion 50. The fastening arms 51, 52 can for example run parallel to one another. The fastening arms 51, 52 have respective fastening elements 54 of the control element 5 in the region of their free end, for example in the form of regions provided with latching tabs. Also, additional fixing pins 56 extend adjacent to the fastening elements 54 from the respective fastening arm 51, 52.

The clamping spring actuator element has two bearing disks 61, 62 spaced apart from one another. An actuating section 60, which is used to actuate a clamping spring 4 of a conductor terminal 1, extends between the bearing disks 61, 62. In the exemplary embodiment shown, the actuating section 60 bridges a space 63 formed between the bearing disks 61, 62. The space 63 forms a passage space for passing through an electrical conductor. The bearing disks 61, 62 have respective part-circular outer contours 65 with which they can be pivotably mounted on parts of the conductor terminal, so that the actuating lever 5, 6 moves essentially on a circular path during a pivoting movement. The outer contours 65 of the bearing disks 61, 62 can alternatively also have an eccentric contour, for example, so that the movement path of the actuating section 60 can be influenced in a targeted manner in terms of construction.

The bearing disks 61, 62 also have fastening elements 64 which are designed as counterparts to the fastening elements 54 of the control element 5. The fastening elements 64 are designed, for example, as recesses or grooves in the bearing disks 61, 62, so that the corresponding fastening elements 54 of the control element 5 can be inserted therein. For additional fixing of the control element 5 on the clamping spring actuator element 6, the bearing disks 61, 62 have recesses 66. With regard to their shape, the recesses 66 are designed as a counterpart to the fixing pins 56 of the control element 5. If the control element 5 is latched to the clamping spring actuator element 6 via the fastening elements 54, 64, the fixing pins 56 fully engage in the recesses 66. An outer contour 68 of the bearing disks 61, 62 facing the fastening arms 51, 52 then advantageously rests against an outer contour 57 of the fastening arms 51, 52 facing the bearing disks 61, 62, wherein the area of the outer contour 68 of the bearing disks 61, 62 can be larger in each case than the areas of the outer contour 57 of the fastening arms 51, 52. This has the advantage that the mutual contact of the outer contours 68 and 57 creates additional support for the transmission of forces during a pivoting movement of the actuating lever 5, 6.

Figure 2B:
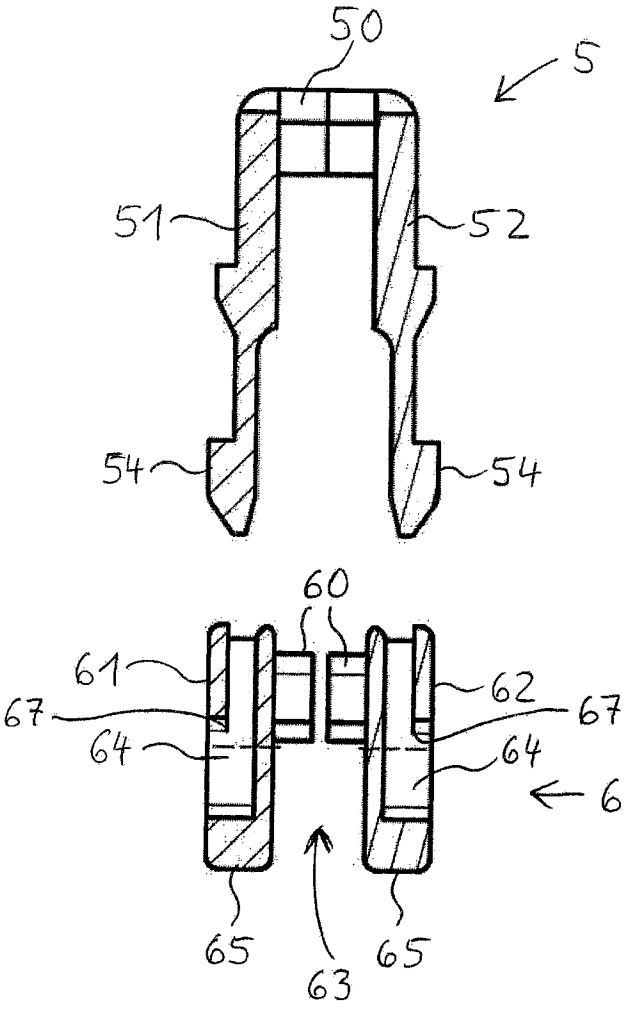
FIGS. 2A and 2B show an actuating lever in a perspective view and a sectional view.
Figure 2A:
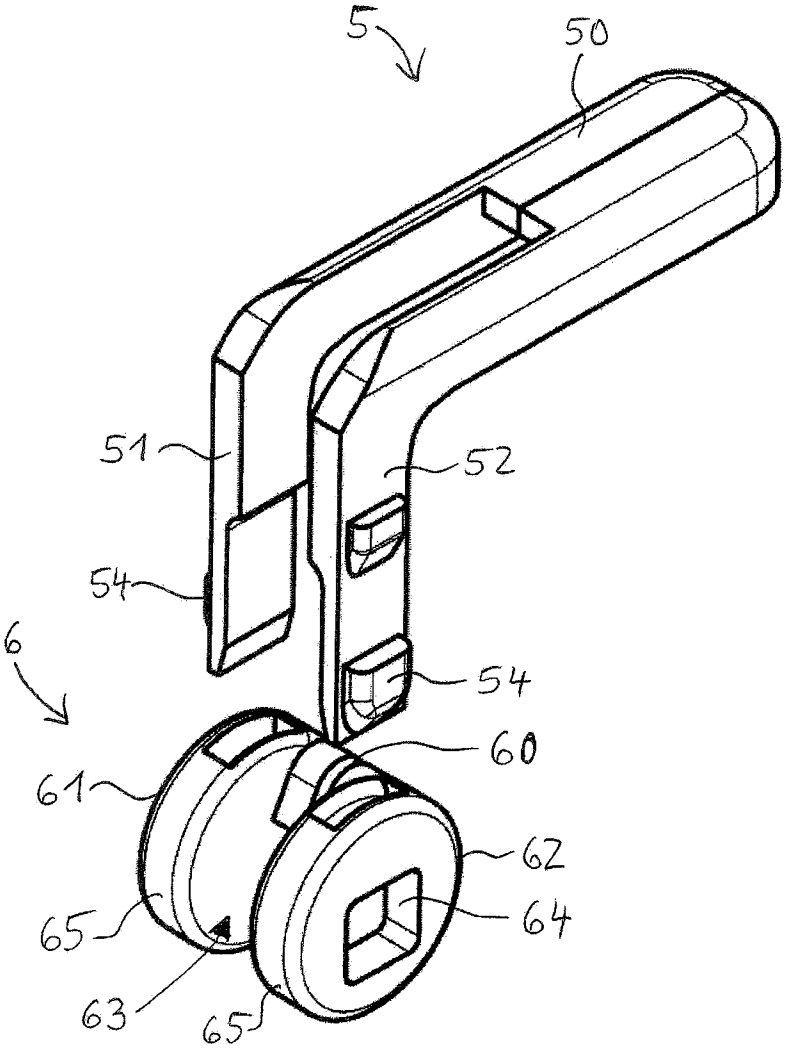

FIG. 2 shows an alternative embodiment of an actuating lever 5, 6. Whereas in the embodiment of FIG. 1, the fastening elements 54, 64 have a latching effect and thus comprise the latch in the radial direction with respect to the part-circular outer contour 65 of the bearing disks, in the embodiment of FIG. 2, an axial direction of the latching is shown.

The control element 5 in turn comprises the handle portion 50 and the fastening arms 51, 52 protruding therefrom. The fastening elements 54 of the control element 5 present on the fastening arms 51, 52 in this case laterally project from the fastening arms, i.e. with respect to the pivoting plane of the actuating lever and the part-circular outer contour 65 of the bearing disks 61, 62, in the axial direction of a pivot axis. In the embodiment shown, the fastening elements 54 point away from one another, i.e. they are arranged on surfaces of the fastening arms 51, 52 pointing away from one another. One or both of the fastening elements 54 can also be on the opposite surface such that one or both of the fastening elements extend into the area between the fastening arms 51, 52.

The clamping spring actuator element 6 in turn has two bearing disks 61, 62, which are spaced apart from one another by a space 63. In this case, the actuating section 60 is designed in two parts, namely as a respective pin protruding from a bearing disk 61, 62 into the space 63, but it can alternatively also be designed in one piece as in the first exemplary embodiment. Correspondingly, in this embodiment the actuating lever 5, 6 is also designed in three parts, namely on the one hand with the control element 5 and on the other hand with the respective bearing disks 61, 62 with their portions of the actuating section 60, which are designed as separate components. Alternatively, the control element 5 can also be designed in two parts, namely with a dividing plane in the pivoting plane of the actuating lever, so that one part comprises the fastening arm 51 and the other part the fastening arm 52, with a respective "half" section of the handle portion 50 connecting to the respective fastening arms 51, 52.

The bearing disks 61, 62 in turn have fastening elements 64, which can be designed, for example, as recesses with a latching edge. If the fastening arms 51, 52 with their fastening elements 54 are inserted into these recesses, the fastening elements 54 snap into place behind the respective latching edges 67.

Figure 3:
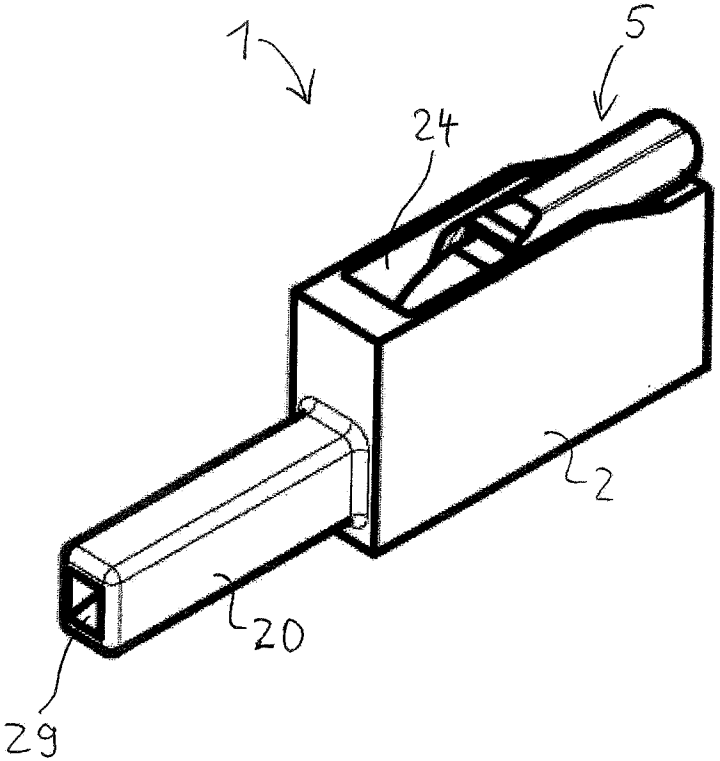
FIG. 3 shows a conductor terminal in a perspective view.

FIG. 3 shows a conductor terminal 1 with a housing 2 and an actuating lever, of which only the control element 5 can be seen in FIG. 3. The control element 5 extends through an actuation opening 24 of the housing 2 into the interior of the housing 2.

In the exemplary embodiment shown, the conductor terminal 1 has a plug-in section 20 which ends with a plug-in opening 29. In this way, the conductor terminal 1 can be designed as an electrical plug connector with a spring force terminal connection. The plug-in section 20 can be plugged together with the plug-in opening 29 using a connector assigned as a counterpart.

Figure 4:
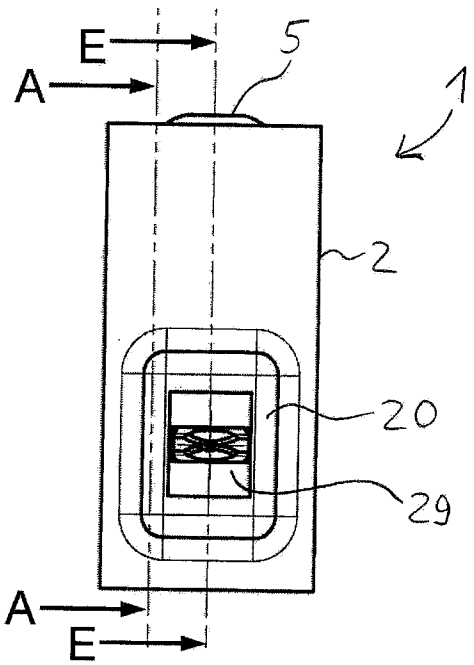
FIG. 4 shows the conductor terminal according to FIG. 3 in a front view.

FIG. 4 shows the conductor terminal 1 in a front view of the plug-in section 20 and the plug-in opening 29. In FIG. 4, two sectional planes A-A and E-E are defined, on the basis of which the internal structure of the conductor terminal 1 is to be explained below. The section plane A-A goes through the plane of the fastening arm 51 and the bearing disk 61; the section plane E-E is a central section plane through the conductor terminal 1.

Figure 5:
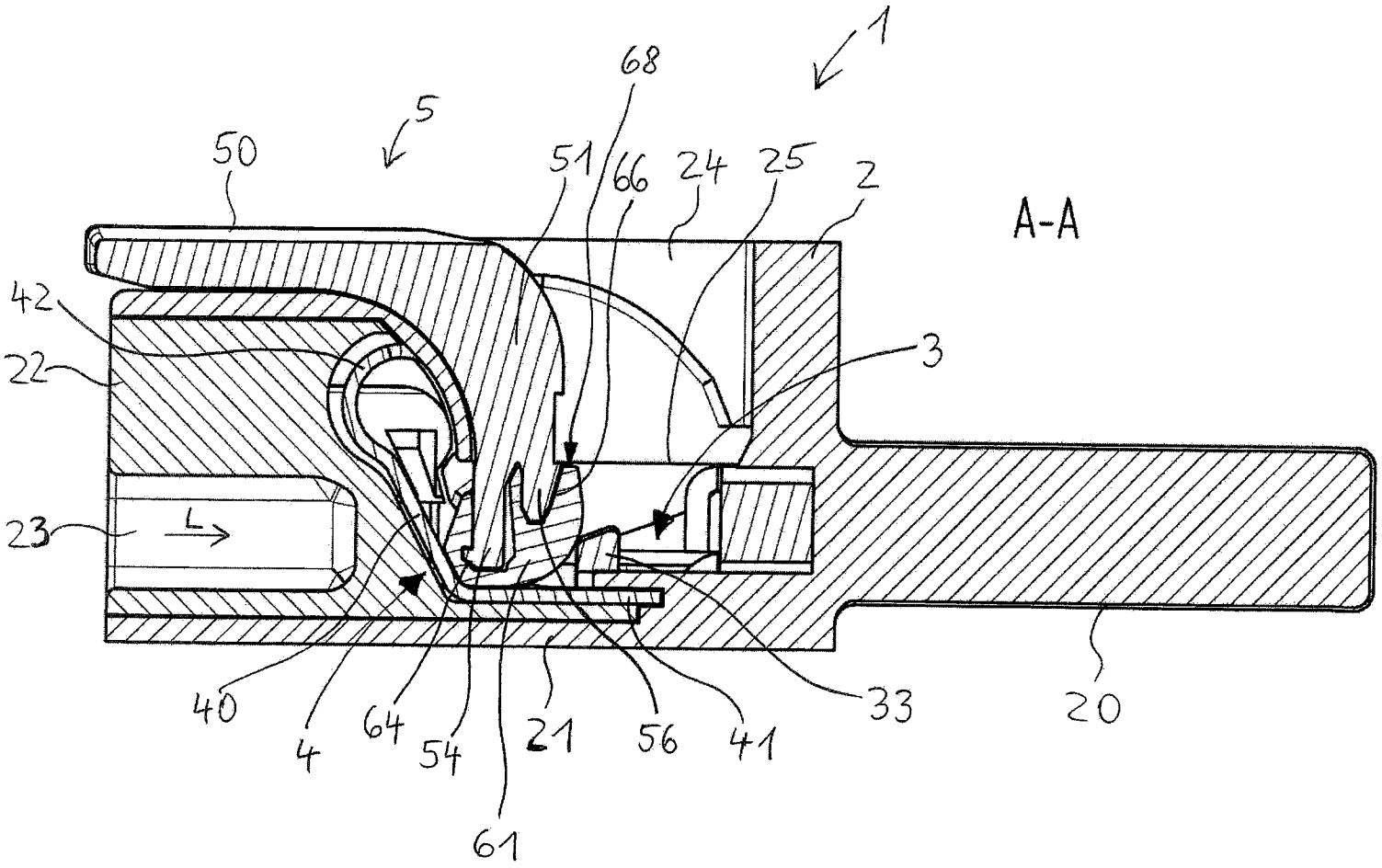
FIG. 5 shows a sectional side view of the conductor terminal according to FIGS. 3 and 4 in the sectional plane A-A illustrated in FIG. 4.

FIG. 5 shows the sectional view along the sectional plane A-A. As FIG. 5 shows, the housing 2 is designed in two parts with a main housing part 21 and a closure part 22. The closure part 22 is inserted into the main housing part 21 when the components which are explained below and arranged therein are installed. The main housing part 21 has the plug-in section 20. In addition, the main housing part 21 includes the actuation opening 24. As can be seen, the control element 5 extends through the actuation opening 24 to the clamping spring actuator element 6. In particular, the form-fitting connection between the fastening elements 54, 64 and, in addition, the support of the control element 5 via the fixing pins 56 inserted into the recesses 66 can be seen.

It can also be seen in FIG. 5 that the outer contour 68 facing the fastening arm 51, with its surface protruding from the outer contour 57 of the fastening arm 51, is supported at least in the illustrated closed position of the actuating lever 5, 6 on a protruding edge 25 located inside the main housing part 21. This advantageously ensures that the actuating lever 5, 6 cannot be removed or fall out of the housing 2 via the actuation opening 24.

The housing 2 has a conductor insertion opening 23 through which an electrical conductor can be inserted into the conductor terminal 1 in a conductor insertion direction L and can be fixed at a clamping point by means of spring force clamping. The conductor insertion opening 23 can, for example, be part of the closure part 22.

In the housing 2 there is a busbar 3 and a clamping spring 4, of which essentially a contact leg 41, a connecting section 40 and a spring arch 42 can be seen in the illustration in FIG. 5. The contact leg 41 is connected to the spring arch 42 via the connecting section 40.

Figure 6:
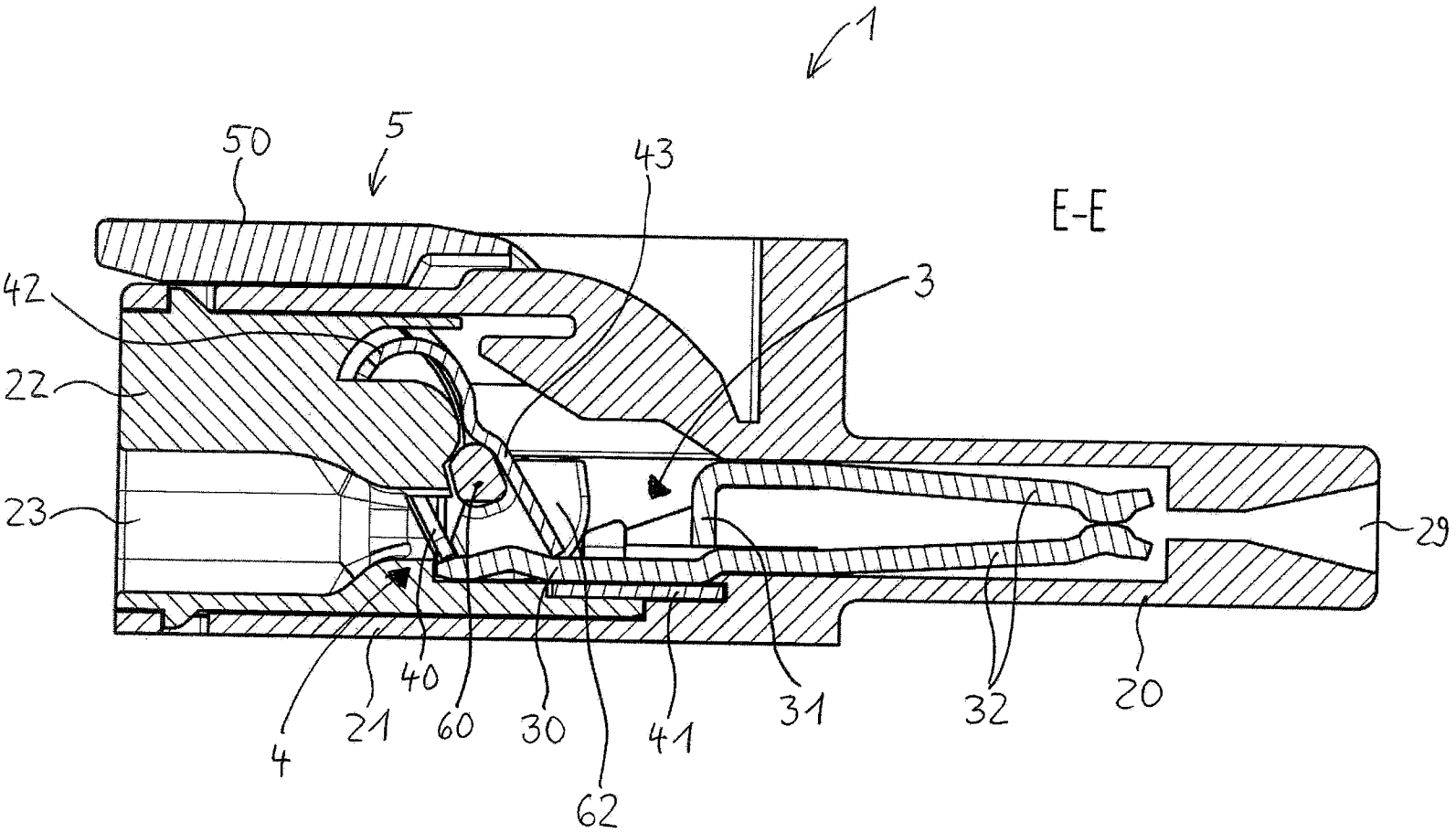
FIG. 6 shows a sectional side view of the conductor terminal according to FIGS. 3 and 4 in the sectional plane E-E illustrated in FIG. 4.

Pursuant to the other sectional plane E-E, FIG. 6 shows further details of the clamping spring 4 and the busbar 3. It can be seen that the clamping spring 4 has a clamping leg 43 following the spring arch 42. The clamping leg 43 can be acted upon by the actuating section 60 and be deflected at a pivoting of the actuating lever 5, 6. As a result, the clamping leg 43 is moved away from the contact leg 41.

The busbar 3 has a conductor clamping section 30. The conductor clamping section 30 together with the clamping leg 43 forms a clamping point for clamping an electrical conductor. The busbar 3 extends from the conductor clamping section 30 over an intermediate area 31 to an electrical plug contact 32, which, for example, can be formed by fork tongues. The intermediate area 31 can also serve as a conductor stop to limit the insertion depth of an electrical conductor into the conductor terminal 1.

From the busbar 3, viewed in the conductor insertion direction L, in this embodiment two tabs 33 are bent laterally behind the bearing disks 61, 62 in the direction of the actuation opening 24, preferably at right angles. When viewed in the conductor insertion direction L, these tabs are aligned with the plane of the bearing disks 61, 62 and thus advantageously form a guide for the electrical conductor, in particular for stranded or finely stranded electrical conductors, which consist of a large number of individual strands.

The connecting section 40 can, for example, have an opening or recess through which an electrical conductor can be inserted through the conductor insertion opening 23 in the conductor insertion direction L and can be guided to the clamping point between the clamping leg 43 and the conductor clamping section 30. The busbar 3 can be narrow enough that it extends through the space 63 between the bearing disks 61, 62. The contact leg 41 can rest on the busbar 3 on the side of the busbar 3 facing away from the clamping leg 43.

It can also be seen that the conductor insertion opening 23 tapers in the interior of the closure part 22 in a funnel shape in the direction of the opening or the recess of the connecting section 40. The funnel-shaped tapering is designed in such a way that an area of the closure part 22 is arranged in front of the actuating section 60, as viewed in the conductor insertion direction L, so that the actuating section 60 is covered by a portion of the closure part 22 in the conductor insertion direction. The actuating section 60 thus advantageously does not represent an obstacle to the introduction of the electrical conductor.

Figure 7:
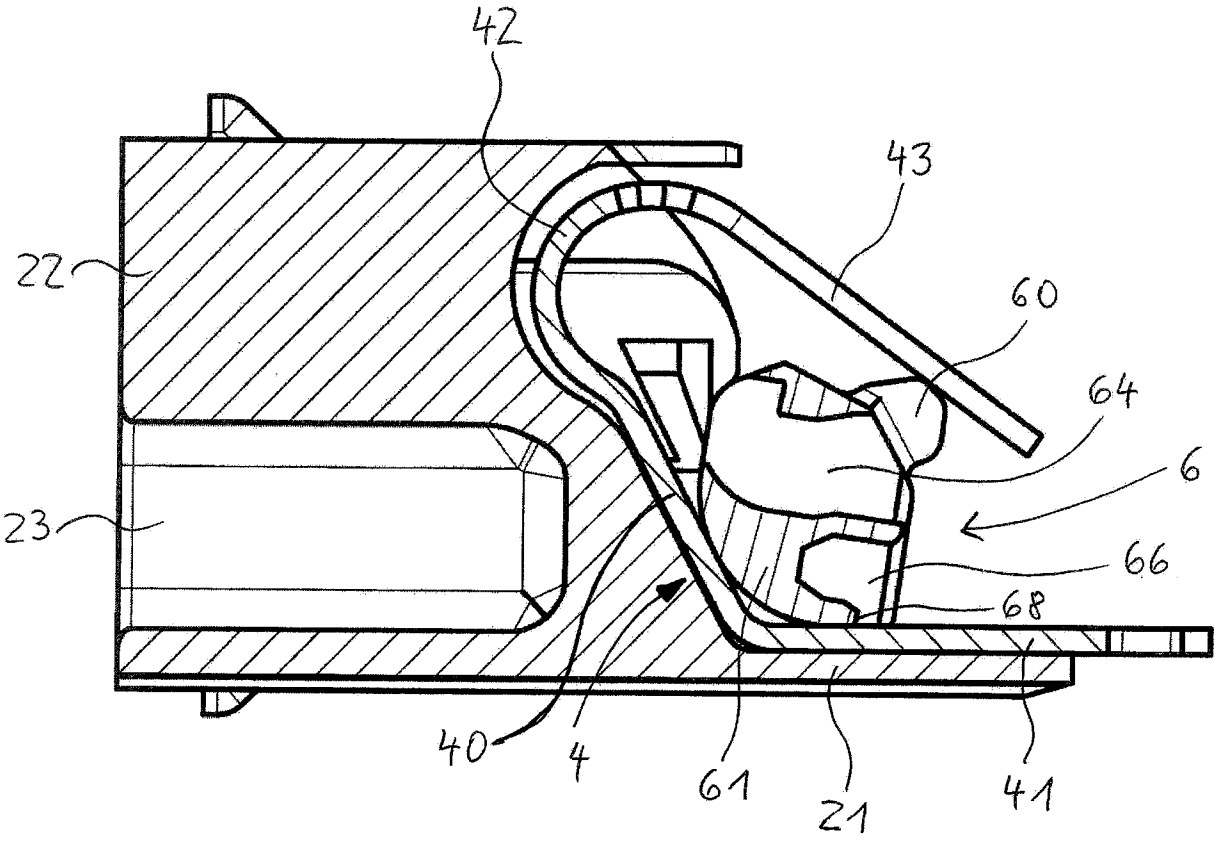
FIG. 7 shows a sectional side view of a first assembly module of the conductor terminal in the sectional plane A-A.
Figure 8:
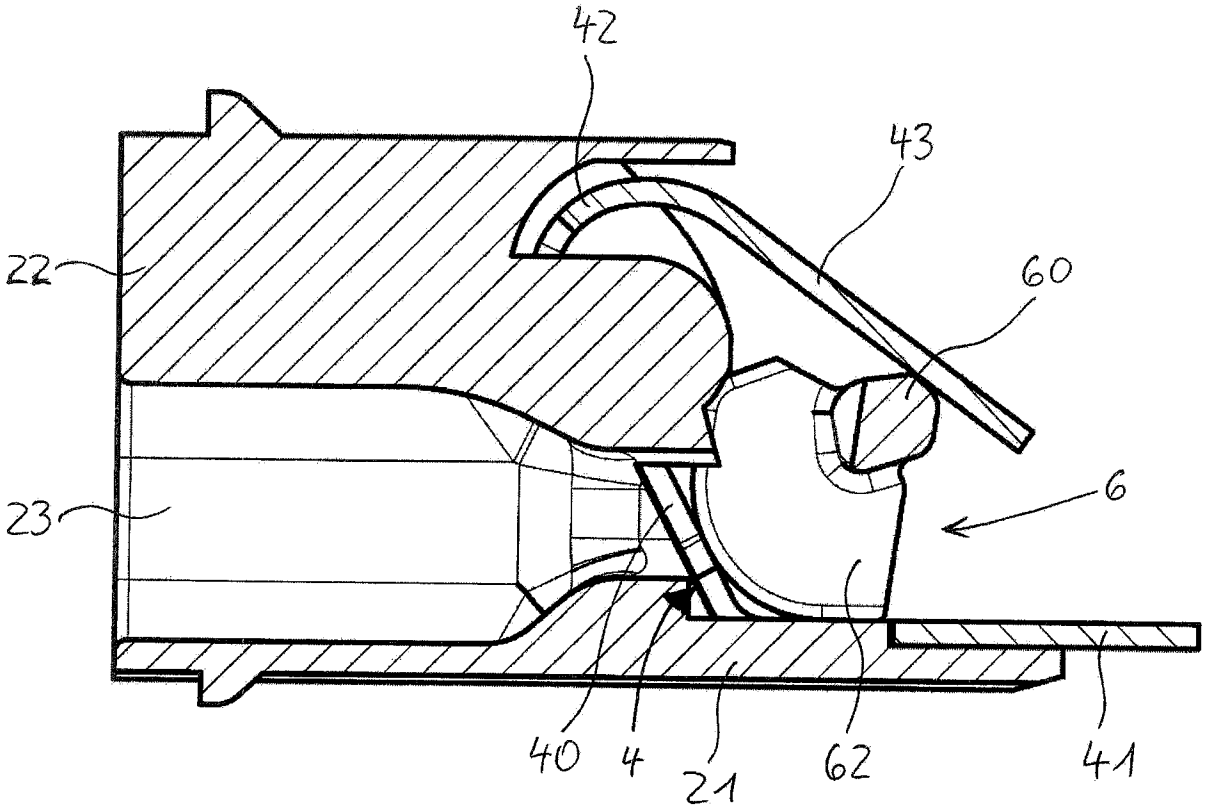
FIG. 8 shows a sectional side view of the first assembly module in the sectional plane E-E.
Figure 9:
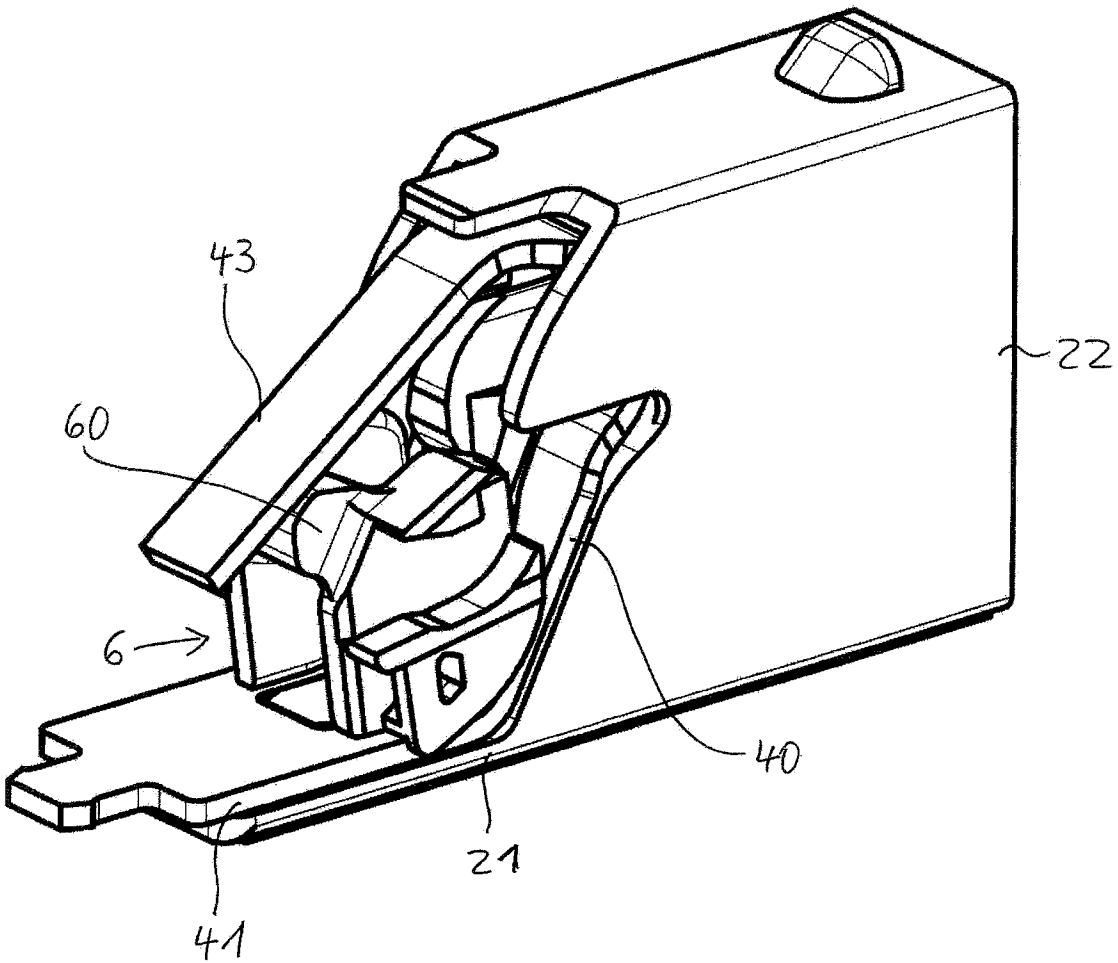
FIG. 9 shows the first assembly module in a perspective view.

FIGS. 7 to 9 each show the first assembly module of the conductor terminal 1. The first assembly module has the closure part 22 as the first housing part. The clamping spring 4 and the clamping spring actuator element 6 are already arranged in the closure part 22. The clamping spring actuator element 6 has been aligned in an assembly position in which the fastening element 64 and the recess 66 point in the direction of a space which is formed between the clamping leg 43 and the contact leg 41. Through this space, the control element 5, preceding its fastening element 54 and the fixing pin 56, can then be inserted into the fastening element 64 and the recess 66, whereby the at least form-fitting connection between the control element 5 and the clamping spring actuator element 6 is established. The clamping spring actuation element 6 is fixed in this first assembly module in that it is held between the clamping leg 43 and the contact leg 41 by the clamping spring 4 and is additionally supported by the connecting section 40.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor terminal comprising:

at least one spring force terminal connection for connection of an electrical conductor via spring force clamping;

a clamping spring;

a housing; and an actuating lever that is pivotably mounted in the housing in a pivoting plane for actuating the clamping spring, the actuating lever being formed at least in two parts with at least one clamping spring actuator element and at least one control element, wherein the clamping spring actuator element has at least one actuating section to actuate the clamping spring, and the control element has at least one handle portion for manual operation of the actuating lever, and wherein the control element and the clamping spring actuator element comprise mutually corresponding fastening elements via which the control element and the clamping spring actuator element are mutually connected in a form-fitting and/or force-fitting manner and are fixed in position to each other at least in a pivoting plane of the actuating lever.

2. The conductor terminal according to claim 1, wherein the control element and the clamping spring actuator element are fixed in position to each other in a form-fitting and/or form-fitting connection via the mutually corresponding fastening elements in all spatial directions.

3. The conductor terminal according to claim 1, wherein the clamping spring actuator element has two spaced-apart bearing disks that are pivotably mounted on portions of the conductor terminal, and wherein the actuating section extends between the bearing disks.

4. The conductor terminal according to claim 3, wherein the bearing disks each have a part-circular outer contour.

5. The conductor terminal according to claim 1, wherein the bearing disks each have fastening elements which correspond with fastening elements of the control element so that the control element is connectable form-fittingly and/or force-fittingly with the bearing disks.

6. The conductor terminal according to claim 3, wherein a passage space is provided between the bearing disks for passing an electrical conductor through to a clamping point of the spring force terminal connection.

7. The conductor terminal according to claim 1, wherein the clamping spring actuator element is at least partially supported and/or mounted on a portion of the clamping spring.

8. The conductor terminal according to claim 1, wherein the form-fitting and/or force-fitting connection between the control element and the clamping spring actuator element is releasable or non-releasable.

9. The conductor terminal according to claim 1, wherein the conductor terminal is composed of a first and a second assembly module.

10. The conductor terminal according to claim 9, wherein the first assembly module has a first housing part of the housing of the conductor terminal, the clamping spring and the clamping spring actuator element.

11. The conductor terminal according to claim 9, wherein the second assembly module has a second housing part of the conductor terminal housing, a busbar and the control element.

12. A method for assembling a conductor terminal according to claim 1, the method comprising:

providing a first assembly module;

providing a second assembly module; and joining the first and second assembly module, wherein the control element and the clamping spring actuator element are form-fittingly and/or force-fittingly connected and are fixed in position to each other at least in the pivoting plane of the actuating lever.

13. A method according to claim 12, wherein the first assembly module is formed with the following steps:

providing the first housing part;

inserting the clamping spring (4) into the first housing part;

deflecting the clamping leg of the clamping spring away from the contact leg of the clamping spring and inserting the clamping spring actuator element through a free space formed between the clamping leg and the contact leg into an area between the clamping leg and the contact leg; and if necessary, aligning the clamping spring actuator element into an assembly position in which the clamping spring actuator element is form-fittingly and/or force-fittingly connected to the control element.

14. The method according to claim 12, wherein the second assembly module is formed with the following steps:

inserting the busbar into the second housing part, inserting the control element of the actuating lever into the actuation opening of the second housing part; and if necessary, aligning the control element into an assembly position in which the clamping spring actuator element is form-fittingly and/or force-fittingly connected to the control element.

* * * * *